United States Patent [19]

House

[11] Patent Number: 4,459,222

[45] Date of Patent: Jul. 10, 1984

[54] ELECTRICALLY CONDUCTING POLYMERS

[75] Inventor: David W. House, Arlington Heights, Ill.

[73] Assignee: UOP Inc., Des Plaines, Ill.

[21] Appl. No.: 377,112

[22] Filed: May 11, 1982

[51] Int. Cl.[3] ..... H01B 1/06

[52] U.S. Cl. ..... 252/500; 252/518; 252/514; 528/397; 528/422; 528/490; 528/488; 528/487; 524/612

[58] Field of Search ..... 252/512, 514, 518, 500; 528/397, 422, 487, 490, 488; 524/612, 438, 411, 412, 429, 401; 525/356, 357, 360, 540

[56] References Cited

U.S. PATENT DOCUMENTS

| | | | |
|---|---|---|---|
| 3,437,695 | 4/1969 | Kruse | 528/397 |
| 4,018,735 | 4/1977 | Nakagawa et al. | 524/612 |
| 4,222,903 | 9/1980 | Heeger et al. | 252/518 |
| 4,359,411 | 11/1982 | Kim et al. | 252/518 |

*Primary Examiner*—Josephine Barr

*Attorney, Agent, or Firm*—James R. Hoatson, Jr.; Eugene I. Snyder; William H. Page, II

[57] ABSTRACT

Although poly(nitrilo-1,4-phenylene nitrilomethylidine-1,4-phenylene methylidine) is an insulator, it can be doped with both electron acceptors and electron donors to afford p- and n-type semiconductors. The iodine doped material is more stable in air than many prior art conducting polymers.

6 Claims, No Drawings

ELECTRICALLY CONDUCTING POLYMERS

BACKGROUND OF THE INVENTION

Although organic polymers have replaced metals in many structural contexts, thus far they have failed to replace metals when the latter are used as electrical conductors or semiconductors. The impetus for such replacement includes, among others, lower cost, lower weight of materials, and increased processing variability for polymers as compared with metals. For example, polymers readily can be cast as films, foils, and fibers by standard, time-tested procedures. Polymers can be formed into a limitless variety of shapes and dimensions by standard processing procedures, thereby adding to the potential benefit of electrically conducting polymers.

A potential use for electrically conducting polymers is as electrodes or components of batteries, where their low weight and possibly unlimited scope of design are attractive. Electrically conducting polymers also could find use in construction of solar cells. Where such polymers are photoconducting they would undoubtedly find applications in the electrophotographic industry.

The conductivity ranges characterizing insulators, semi-conductors, and metallic conductors are somewhat arbitrary, but for convenience we may say an insulator has a conductivity less than about $10^{-10}$ $ohm^{-1}$ $cm^{-1}$, a conducting metal has a conductivity greater than about $10^2$ $ohm^{-1}$ $cm^{-1}$, and a semiconductor has a conductivity between the above. Quite often organic polymers which are insulators show a sufficient increase in conducting upon doping to act as semiconductors. By "doping" is meant adding a compound, referred to as a dopant, to the polymer so as to form a redox system wherein an electron is transferred from the polymer to the dopant, or vice versa. Two common examples of dopants are iodine (an electron acceptor) and sodium naphthalide (an electron donor). When the polymer transfers an electron to the dopant to exhibit semiconductor properties it is called a p-type semiconductor because conduction occurs mainly via holes in the valence band. Conversely, when the polymer accepts an electron from the dopant to exhibit semiconductor properties it is called an n-type semiconductor because conduction occurs mainly via electrons in the conduction band.

It is desirable for a normally insulating polymer to become a semiconductor upon doping by both p- and n-type dopants. It is also desirable that the polymer respond to a wide variety of dopants, and for its conductivity to be relatively responsive to changed levels of dopant. It is also desirable that the conductivity properties of the polymer remain stable over time and upon air exposure of the polymer. It is also quite desirable that upon doping the polymer remain flexible rather than becoming brittle.

It is a discovery of this invention that poly(nitrilo-1,4-phenylene nitrilomethylidine-1,4-phenylene methylidine), hereafter referred to as PNPM and whose structure is

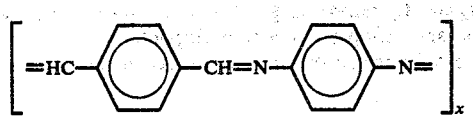

is a polymer which shows many of the aforementioned properties. In particular, PNPM is normally an insulator whose conductivity increases to about $10^{-4}$ $ohm^{-1}$ $cm^{-1}$ upon doping with an electron acceptor such as iodine. In addition to these properties as a p-type semiconductor, PNPM can be doped with an electron donor such as sodium naphthalide to behave as an n-type semiconductor.

Polyacetylene and poly(p-phenylene) exemplify some better, perhaps the best, prior art electrically conducting polymers, hence their limitations exemplify the prior art constraints. Although polyacetylene may be doped with p- and n-type dopants, all doped as well as undoped polyacetylene is unstable in air. Thus the electrical properties, which are of greatest interest in this application, are useful for only short periods in air. In contrast, poly(p-phenylene) itself is air stable but it affords air unstable, electrically conducting polymers with both p- and n-type dopants. However, these materials invariably are amorphous powders which cannot be cast, hence their processability is severely limited.

DESCRIPTION OF THE INVENTION

In one aspect the invention which is disclosed and claimed is a method of preparing an electrically conducting polymer comprising contacting PNPM with a dopant, and recovering the resulting doped polymer.

In another aspect the invention is the electrically conducting polymer itself, which comprises PNPM and a dopant in a mole ratio up to about 4.

The polymer of this invention has an extended, linear conjugated system which is believed to afford the basis of electron flow. In its ground state the polymer has its highest bonding orbital completely filled, and its lowest antibonding orbital totally unoccupied. In such a state the polymer would be nonconducting,—i.e., an insulator—because of the absence of charge carriers, despite the fact that both orbitals above are extensively delocalized. If the gap between the aforementioned orbitals was sufficiently small, thermal excitation would promote some fraction of electrons from the highest bonding orbital, or valence band, into the lowest antibonding orbital, or conduction band. There would be "holes" in the valence band and electrons in the conduction band, both of which are charge carriers, and the polymer would be electrically conducting. A similar electron transfer would accompany absorption of light, in which case the polymer would be a photoconductor.

Because the band gap of the polymer in question is too large for appreciable thermal population of the conduction band, a different mode of introducing charge carriers is needed. As stated above, dopants are materials which form a redox system with the subject polymer. The function of a dopant is to introduce charge carriers into the polymer. Where the dopant is an oxidizing agent and removes an electron from the highest filled orbital of the polymer it creates "holes" in the valence band which are p-type charge carriers. Analogously, where the dopant is a reducing agent and adds an electron to the lowest unoccupied orbital of the polymer it puts electrons into the conduction band which are n-type charge carriers. Dopants which cause a polymer to behave as p- or n-type conductors, respectively, are called p- or n-type dopants.

The polymer of this invention has the repeating unit,

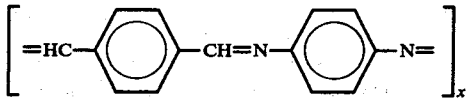

and may be prepared by reacting in solution approximately equimolar proportions of 1,4-bis(dihalomethyl)-benzene and 1,4-diaminobenzene at a temperature of from about 20° C. to about 100° C. in the presence of a base to neutralize formed acid. A polar, aprotic solvent such as dimethylacetamide, is advantageous for the polymer can be readily cast from solutions in such solvents to afford films which are insoluble upon drying. 1,4-Bis(dibromomethyl)benzene is a reactant of choice, although the chloro and iodo analogues may be used, not necessarily with equivalent results.

The polymer itself is an insulator, showing a conductivity less than $10^{-10}$ ohm$^{-1}$ cm$^{-1}$. However, when doped with either p-type or n-type dopants the conductivity increases to about $10^{-4}$ ohm$^{-1}$ cm$^{-1}$. Where the dopant is itself air stable, it has been found that the electrically conducting doped polymer is air stable as manifested by unchanged conductivity.

As examples of p-type dopants there may be cited bromine, chlorine, and iodine; $SbF_5$, $AsF_5$, $PF_5$, and related compounds where fluorine is replaced by a highly electronegative, non-nucleophilic group; $AgClO_4$ as representative of a silver compound with a non-nucleophilic anion; $NO_2X$ and NOX, where X is a non-nucleophilic anion such as $SbF_6^-$, $BF_4^-$, and so on; and sulfuric and perchloric acids.

Examples of n-type dopants are more limited. The most common such dopants are alkali metal salts of the radical anions of aromatic systems, as exemplified by sodium naphthalide.

Electrochemical doping introduces additional dopants. For example, the tetraalkylammonium cation is an effective p-dopant, whereas halide anions are effective n-dopants when an electrochemical doping method is employed.

The amount of dopant incorporated into the polymer to give the electrically conducting system is subject to wide variation, depending, for example, on the dopant and the conductivity desired. In the case of iodine, for example, the mole ratio dopant to repeating unit of polymer may be as low as about 0.8 and up to about 3.3. In the more general case the mole ratio, similarly defined, may be up to about 4, with a ratio from about 0.1 to about 3.5 being most commonly employed.

The examples given below merely serve to illustrate this invention and are not intended to limit it in any way.

EXAMPLES

Amorphous PNPM was prepared as follows. To a 100 ml 3-necked round bottom flask equipped with a mechanical stirrer and reflux condenser were added, under nitrogen, 1.00 g (2.37 mmol) of freshly recrystallized 1,4-bis(dibromomethyl)benzene in 15 ml of dimethylacetamide and 0.26 g (1 equivalent) of sublimed 1,4-diaminobenzene. After the solution was stirred for 30 minutes at room temperature and 22 hours at 55° C., 5 ml of triethylamine was added. After an additional 3.5 hours at 55° C., the mixture was poured into 75 ml of methanol to dissolve the salts. The yellowish orange precipitate which formed was filtered and washed repeatedly with methanol followed by diethyl ether to yield 0.40 g of yellowish orange powder which, when dried in vacuo at 100° C. for 30 minutes, changed to brownish red.

To prepare films the preparation of PNPM was modified by eliminating admixture of the reaction mixture with methanol. Instead the reaction mixture was filtered through glass wool to produce a clear, dark liquid of a concentration of about 1.0 g polymer to 20 ml solvent. The solution then could be cast onto a glass plate using a Gardner knife. When the plate was dried overnight a clear, dark red polymer film was obtained.

Pellets for electrical conductivity testing were prepared by adding a measured amount of the polymer powder to a Beckman IR pellet press. The pellets were 1.3 cm in diameter with a thickness determined by the amount of material pressed and the pressure used.

To obtain reliable conductivity data which could be duplicated it was found necessary to dry the material thoroughly in vacuum. Accordingly, after being pressed all pellets were dried at 100° C. at 0.2 mm Hg for several hours. Pellets normally were removed and stored under nitrogen until testing.

Iodine doping was carried out by adding an iodine crystal to a chamber containing a pellet of PNPM. The chamber then was evacuated causing immediate sublimation of iodine. Gaseous iodine remained in contact with a pellet for a period from about 3 to about 20 hours, whereupon the doped pellet was removed and stored under nitrogen until being tested.

Doping of PNPM with sodium naphthalide was accomplished by contacting the polymer powder with a slurry of sodium naphthalide in dry tetrahydrofuran. After the mixture was stirred under nitrogen for 24 hours, excess sodium naphthalide and solvent were removed with a pipette. The remaining solvent was evaporated in a stream of nitrogen and the doped polymer was dried as described above but at room temperature.

Electrochemical doping of PNPM can be readily effected. In one example a graphite rod was the cathode and a polymer film about 0.003 inch thick on a glass was the anode. The electrodes were positioned about 5 mm apart in an electrolyte of 0.5 molar aqueous solution of potassium iodide at 20 volts.

In another experiment solvent from the reaction mixture was permitted to partially evaporate slowly over a one week period whereupon polymer formed as a thick, porous sheet which, upon being air dried, became a dull, dark gray, self supporting rigid solid. A sample of the latter about 1 cm$^2$ in area and about 0.0330 inches thick was used as the cathode with a graphite rod as the anode set about 4 mm apart in an electrolyte of 0.5 molar tetra-n-butylammonium perchlorate in propylene carbonate at 10 volts.

To determine the air stability of the conductivity of $I_2$-doped PNPM, pellets were stored in air in a capped vial and tested periodically. Results are summarized in Table 2. In a similar test, PNPM doped electrochemically as in the prior paragraph showed no change in conductivity upon air storage even after 111 days.

TABLE 1

Conductivity of PNPM and Doped PNPM

| Dopant | Pellet Thickness (inch) | Pellet Mass (gram) | Mole Ratio Dopant: PNPM | Conductivity ($ohm^{-1}$ $cm^{-1}$) |
|---|---|---|---|---|
| none[a] | 0.0099 | 0.03 | | $1 \times 10^{-10}$ |
| none[a] | 0.0095 | 0.0282 | | $1.1 \times 10^{-10}$ |
| $I_2$[a] | 0.0157 | — | 3.2 | $1.4 \times 10^{-4}$ |
| $I_2$[a] | 0.0161 | 0.1385 | 3.2 | $1.1 \times 10^{-4}$ |
| $I_2$[a] | 0.0128 | 0.0660 | 0.88 | $1.3 \times 10^{-7}$ |
| none[b] | 0.0166 | 0.0555 | | $<5 \times 10^{-8}$ |
| $I_2$[b] | 0.0218 | 0.1713 | 1.7 | $7.2 \times 10^{-5}$ |
| none[c] | 0.0005 | | | $<5 \times 10^{-8}$ |
| $I_2$[c] | 0.0005 | | ca. 1.7 | $1.3 \times 10^{-4}$ |
| sodium naphthalide | 0.0095 | 0.039 | >1 | $1.1 \times 10^{-5}$ |
| KI[e] | 0.0003 | | | $5.9 \times 10^{-5}$ |
| $n\text{-}Bu_4N^{\oplus}ClO_4^{\ominus}$[f] | 0.0277 | | | $1.8 \times 10^{-4}$ |

[a]Amorphous powder
[b]Glassy pellet
[c]Film
[d]Under nitrogen
[e]Electrochemical doping, film as anode
[f]Electrochemical doping, porous disc as cathode

TABLE 2

Air Stability of $I_2$ - Doped PNPM

| Time (days) | Conductivity ($ohm^{-1}$ $cm^{-1}$) |
|---|---|
| 0 | $1.4 \times 10^{-4}$ |
| 4 | $0.8 \times 10^{-4}$ |
| 7 | $1.1 \times 10^{-4}$ |

TABLE 2-continued

Air Stability of $I_2$ - Doped PNPM

| Time (days) | Conductivity ($ohm^{-1}$ $cm^{-1}$) |
|---|---|
| 221 | $1.8 \times 10^{-6}$ |

What is claimed is:

1. A method of preparing an electrically conducting polymeric composition comprising contacting poly(nitrilo-1,4-phenylene nitrilomethylidine-1,4-phenylene methylidine) with an electron acceptor or electron donor dopant in an amount, sufficient to increase electrical conductivity, from about 0.1 to about 3.5 mole ratio dopant per repeating unit of the polymer, and recovering the resulting doped polymer.

2. The method of claim 1 where the electron donor dopant is sodium naphthalide.

3. The method of claim 1 where the dopant is selected from the group consisting of bromine, iodine, $SbF_5$, $AsF_5$, $PF_5$, $AgClO_4$, $NO_2X$, and NOX where X is $SbF_6^-$ or $BF_4^-$.

4. An electrically conducting polymeric composition comprising poly(nitrilo-1,4-phenylene nitrilomethylidine-1,4-phenylene methylidine) and an electron donor or electron acceptor dopant in an amount, sufficient to increase electrical conductivity, from about 0.1 to about 3.5 mole ratio dopant per repeating unit of the polymer.

5. The composition of claim 4 where the electron acceptor dopant is sodium naphthalide.

6. The composition of claim 4 where the dopant is selected from the group consisting of bromine, iodine, $SbF_5$, $AsF_5$, $PF_5$, $AgClO_4$, $NO_2X$, and NOX where X is $SbF_6^-$ or $BF_4^-$.

* * * * *